US011273972B2

(12) United States Patent
Bodet et al.

(10) Patent No.: US 11,273,972 B2
(45) Date of Patent: Mar. 15, 2022

(54) VALVE BODY TO BE MOUNTED ON A CUP

(71) Applicant: LINDAL FRANCE SAS, Val-de-Briey (FR)

(72) Inventors: Hervé Bodet, Verdun (FR); Eric Gaillard, Dieue sur Meuse (FR)

(73) Assignee: LINDAL FRANCE SAS, Val-de-Briey (FR)

( * ) Notice: Subject to any disclaimer, the term of this patent is extended or adjusted under 35 U.S.C. 154(b) by 0 days.

(21) Appl. No.: 17/059,357

(22) PCT Filed: May 27, 2019

(86) PCT No.: PCT/EP2019/063692
§ 371 (c)(1),
(2) Date: Nov. 27, 2020

(87) PCT Pub. No.: WO2019/229004
PCT Pub. Date: Dec. 5, 2019

(65) Prior Publication Data

US 2021/0237962 A1 Aug. 5, 2021

(30) Foreign Application Priority Data

May 28, 2018 (FR) ..... 1854513

(51) Int. Cl.
*B65D 83/48* (2006.01)
*B65D 83/38* (2006.01)
*B65D 83/32* (2006.01)

(52) U.S. Cl.
CPC ..... *B65D 83/48* (2013.01); *B65D 83/38* (2013.01); *B65D 83/32* (2013.01)

(58) Field of Classification Search
CPC ..... B65D 83/38; B65D 83/32
(Continued)

(56) References Cited

U.S. PATENT DOCUMENTS 2,775,483 A * 12/1956 Treharne, Jr. ..... B65D 83/425 222/402.25
2,965,271 A * 12/1960 Soffer ..... B65D 83/46 222/542

(Continued)

FOREIGN PATENT DOCUMENTS

| | | | |
|---|---|---|---|
| FR | 1564337 | A | 4/1969 |
| FR | 2039928 | A5 | 1/1971 |
| WO | 2007107174 | A1 | 9/2007 |

OTHER PUBLICATIONS

International Search Report and Written Opinion dated Sep. 9, 2019 in corresponding application No. PCT/EP2019/063692; w/ English partial translation and partial machine translation (total 20 pages).

*Primary Examiner* — Lien M Ngo
(74) *Attorney, Agent, or Firm* — Seckel IP, PLLC

(57) ABSTRACT

A valve body intended to be fastened to a cup provided with an opening to form an aerosol generator valve, which includes a tubular body closed at one of its ends by a closure wall provided with an orifice and extending along a main axis (a), has two parts which are separate before assembly of the valve, one being provided with the closure wall (32) and with a portion or all of the tubular body (31), and the other being provided with another closure wall (22) provided with another orifice (23) and, where appropriate, with the rest of the tubular body. Each part is provided with a bearing surface (241) and with fastening means (25, 35). The two parts are fastened to each other by their fastening means (25, 35) while clamping, between their respective bearing surfaces (241, 341), the cup at an annular portion (121) located around the opening.

20 Claims, 4 Drawing Sheets

Figure 1:
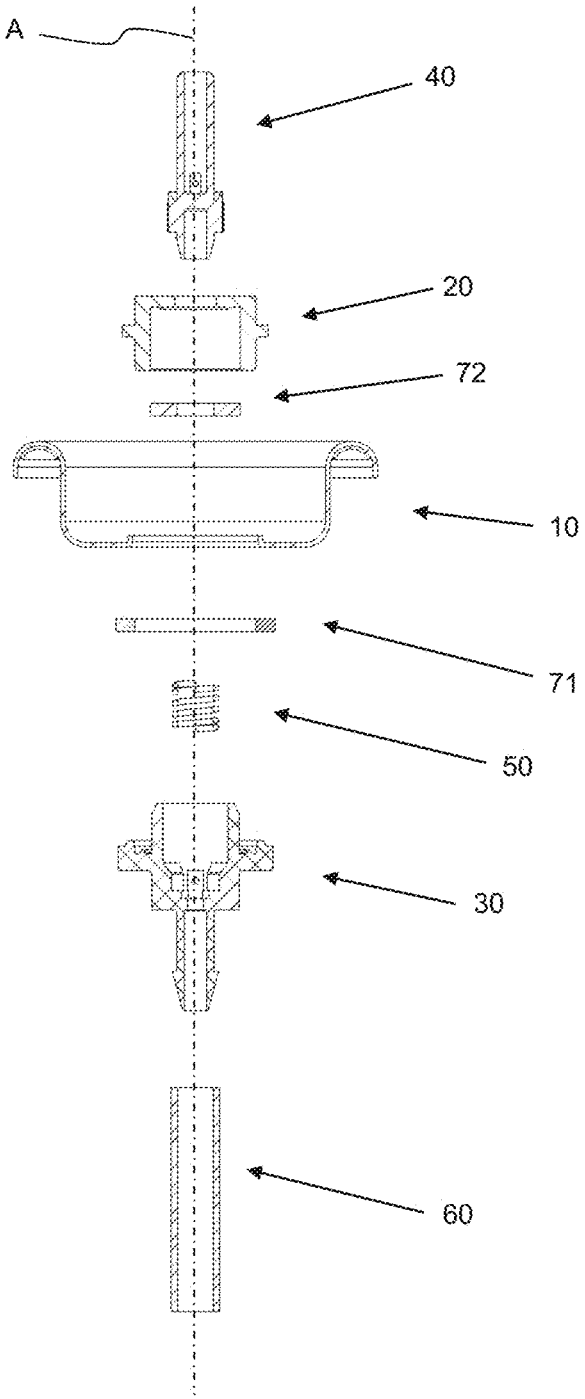

(58) Field of Classification Search
USPC ..... 222/402.1, 402.11–402.25
See application file for complete search history.

(56) References Cited

U.S. PATENT DOCUMENTS

| | | | | |
|---|---|---|---|---|
| 3,396,874 | A | 8/1968 | Malone | |
| 7,374,068 | B2 * | 5/2008 | Greer, Jr. ..... | B65D 83/306 222/1 |
| 2009/0078903 | A1 | 3/2009 | Rideg | |

* cited by examiner

VALVE BODY TO BE MOUNTED ON A CUP

The invention relates to a valve body intended to be fastened to a cup provided with an opening in order to form an aerosol generator valve, which valve body comprises a tubular body closed at one of its ends by a closure wall provided with an orifice and extending along a main axis.

The valves for aerosol generators existing on the market are assembled from a certain number of components involving different materials:

- a cup in aluminum or tinplate, coated or not with a varnish, or in a polymer material;
- an outer seal in elastomer;
- a monobloc valve body in polyoxymethylene (POM), polyamide (PA), polyethylene (PE) or polypropylene (PP), or in poly(butylene terephthalate) (PBT);
- an inner seal in elastomer (frequently of a chemical family different from that of the outer seal);
- a valve element in POM or PA, or in PBT, either in the form of a valve seat (sometimes called a piston) in the case of female valves, or in the form of a sprayer (better known under the term stem) in the case of male valves;
- a spring in stainless steel;
- a dip tube in polyethylene (PE).

The assembly process is complex and combines several successive operations, involving the creation of sub-assemblies and requiring on-line control tests to ensure sealing of the assembled valve.

One of the last phases of the assembly is the crimping operation which consists in fitting and sealingly fastening the sub-assembly constituted by the one-piece valve body+stem or valve seat+spring+inner seal on the sub-assembly cup+outer seal.

This phase is critical for the performance of the valve in terms of:

- sealing;
- stem height (mounting of the diffuser);
- valve actuation force;
- valve closure.

The adjustment of the crimping dimensions (diameter and height) is empirical and remains subjective:

- the nominal values used as well as the tolerance intervals have been established empirically;
- the dimensions can vary depending on the wear of the crimping pliers.

During assembly, the stem is placed in the valve body, which is itself placed under the cup, so that the stem passes through a central opening of the cup and protrudes above the outer face of the cup. The valve body is fastened to the cup by expanding the cup on the outside face of the valve body. The cup is itself fastened to the container of the aerosol generator by crimping or expanding.

In the context of the development of aerosol generators made of plastic material, cups made of polymer material are increasingly used. In this case, it is common, either to snap in from below a valve body which is closed in its outer portion by the cup, or to form the valve body directly in the cup and to close the outer portion of the valve body by an added part which is positioned from above on the opening of the valve body and fastened by snap-fastening or by welding to the cup.

An objective of the invention is to provide a valve body and a valve that are easy to manufacture and to assemble, and that can be used equally well with commercial metal cups as with cups made of polymer material.

This objective is achieved in that the valve body is constituted by two parts which are separate before assembly of the valve, one of the two parts being provided with the closure wall and a portion or all of the tubular body, and the other of the two parts being provided with another closure wall provided with another orifice and, if the entire tubular body is not present on the first part, with the rest of the tubular body, each part being provided with a bearing surface and fastening means so that, in the assembled state of the valve, one of the two parts is located on one side of the cup and the other of the two parts is located on the other side of the cup, a portion of at least one of the two parts passing through the opening of the cup so as to protrude on the other side of the cup, the two parts being fastened by their fastening means while clamping, between their respective bearing surfaces, the cup at an annular portion located around the opening, wherein a cup seal may be overmolded on one of the bearing surfaces.

With such a valve body, it is possible to dispense with the expansion of the cup on the valve body, which considerably reduces the dimensional variations, while eliminating the problem associated with the wear of the crimping pliers.

The orifice of one of the two closure walls is preferably dimensioned to allow an outlet rod for the product contained in the aerosol generator to pass through, the rod being carried by a valve element intended to be inserted at least partially into the valve body (thus, by a stem) or by a diffuser intended to actuate the valve, the orifice of the other of the two closure walls being dimensioned to allow the product contained in the aerosol generator to enter the valve body. A fastening tenon may be provided around the orifice intended to allow the product to enter the valve body, on the outer face of the corresponding closure wall, in order to fasten a dip tube, an anti-collapsing device, or any other similar device to the valve body.

It is preferable to provide a first of the two parts of the valve body with a first tubular wall closed at one of its ends by a first of the two closure walls, a first bearing wall being formed on the outer face of the first tubular wall. The face of the first bearing wall opposite to the first closure wall constitutes the first of the two bearing surfaces. In addition, it is preferable to provide the second of the two parts of the valve body with the second of the two closure walls and, if applicable (in other words, if the entire tubular body is not placed on the other part), with a second tubular wall closed at one of its ends by said second closure wall. A second bearing wall is formed at the periphery of the second closure wall or on the outer face of the second tubular wall. The face of the second bearing wall opposite to the outer face of the second closure wall constitutes the second of the two bearing surfaces.

It is preferable that the fastening means of the first part are constituted by a first fastening surface formed on the outer surface of the first tubular wall inside a projection, relative to the main axis, of the first bearing surface. In a variant embodiment, said first fastening surface is formed on the edge of the first tubular wall opposite to the first closure wall.

Likewise, the fastening means of the second part can be constituted by a second fastening surface formed at the periphery of the second closure wall inside a projection, relative to the main axis, of the second bearing surface. In a variant embodiment, the second fastening surface is formed on the second tubular wall, preferably on the edge of the second tubular wall opposite to the second closure wall.

The two fastening surfaces preferably have superimposable shapes, wherein one of the two fastening surfaces may be provided with an extra thickness of material for welding.

This solution is particularly well suited to fastening by welding or gluing, in particular by ultrasonic welding.

In an alternative embodiment of the invention, the first tubular wall is dimensioned to form the tubular body of the valve body, so that, in the assembled state of the valve, the end of the first tubular wall opposite to the first closure wall is in contact with the second closure wall of the other part, preferably with interposition of a seal.

In a development of this variant embodiment, the first fastening surface is formed on the edge of the first tubular wall opposite to the first closure wall, and the second fastening surface is formed on the second closure wall, the second bearing surface being formed on the periphery of the second closure wall, the second part not having a second tubular wall.

In another development of this variant embodiment, the first fastening surface is formed on the outer face of the first tubular wall, preferably on the first bearing wall, even more preferably in a groove formed on the first bearing wall inside the first bearing surface, and the second fastening surface is formed on the edge of the second tubular wall, the second bearing surface being formed on the periphery of the second closure wall or on the outer face of the second tubular wall.

In another variant embodiment of the invention, the first tubular wall and the second tubular wall have superimposable transverse cross-sections and together constitute, in the assembled state of the valve, the tubular body of the valve body. In this case, the first fastening surface is formed by the edge of the first tubular wall opposite to the first closure wall and the second fastening surface is formed by the edge of the second tubular wall opposite to the second closure wall.

To ensure sealing at a lower cost at the interface between the valve body and the valve element (stem or valve seat), it is preferable to provide a valve seal against the inner face of the closure wall provided with the orifice dimensioned to let the product outlet rod located on the valve element or on a diffuser to pass through. This valve seal is then dimensioned to ensure sealing between a valve element placed in the valve body and the inner face of said closure wall, as well as between the product outlet rod (of the stem or of the diffuser) and the orifice of the closure wall. It is preferable that the valve seal is overmolded.

The invention also relates to a valve for an aerosol generator, comprising

- a cup provided with an opening and adapted to be fastened by its peripheral edge to an aerosol container,
- a valve body according to the invention, and
- a valve housed at least partially in the valve body.

According to the invention, one of the two parts is located on one side of the cup and the other of the two parts located on the other side of the cup. The two parts are fastened to each other by their fastening means while clamping between their respective bearing surfaces an annular portion of the cup located around the opening. The formation of the valve is preferably carried out without fastening one of the parts on the cup and/or on the container.

To ensure sealing between the cup and the valve body, it is preferable to interpose a cup seal between the cup and one of the bearing walls. The bearing surface in contact with the cup seal is preferably provided with a sealing rib intended to be compressed against the cup seal in the assembled state of the valve. The cup seal can be dimensioned to also ensure sealing at an interface between the two parts of the valve body. The cup seal may be a separate component, in which case it is preferable that the bearing wall considered is provided with a sealing rib intended to be compressed against the cup seal in the assembled state of the valve. It is also possible to overmold the cup seal on the cup or on the bearing wall of one of the parts of the valve body.

In order to ensure good retention of the cup between the two supporting walls, it is preferable to deform the edge of the opening of the cup towards one of the faces of the cup to form an annular collar, preferably forming a planar annular edge, the edge of the collar bearing against one of the bearing walls in the assembled state of the valve, preferably against the bearing wall against which the cup seal is not interposed.

In a preferred embodiment of the invention, the two parts are fastened to each other while clamping the cup between them by irreversible fastening of their fastening surfaces to each other. This fastening is preferably carried out by welding, optionally using an extra thickness of material for welding provided on one of the fastening surfaces, in particular by ultrasonic welding.

Figure 2:
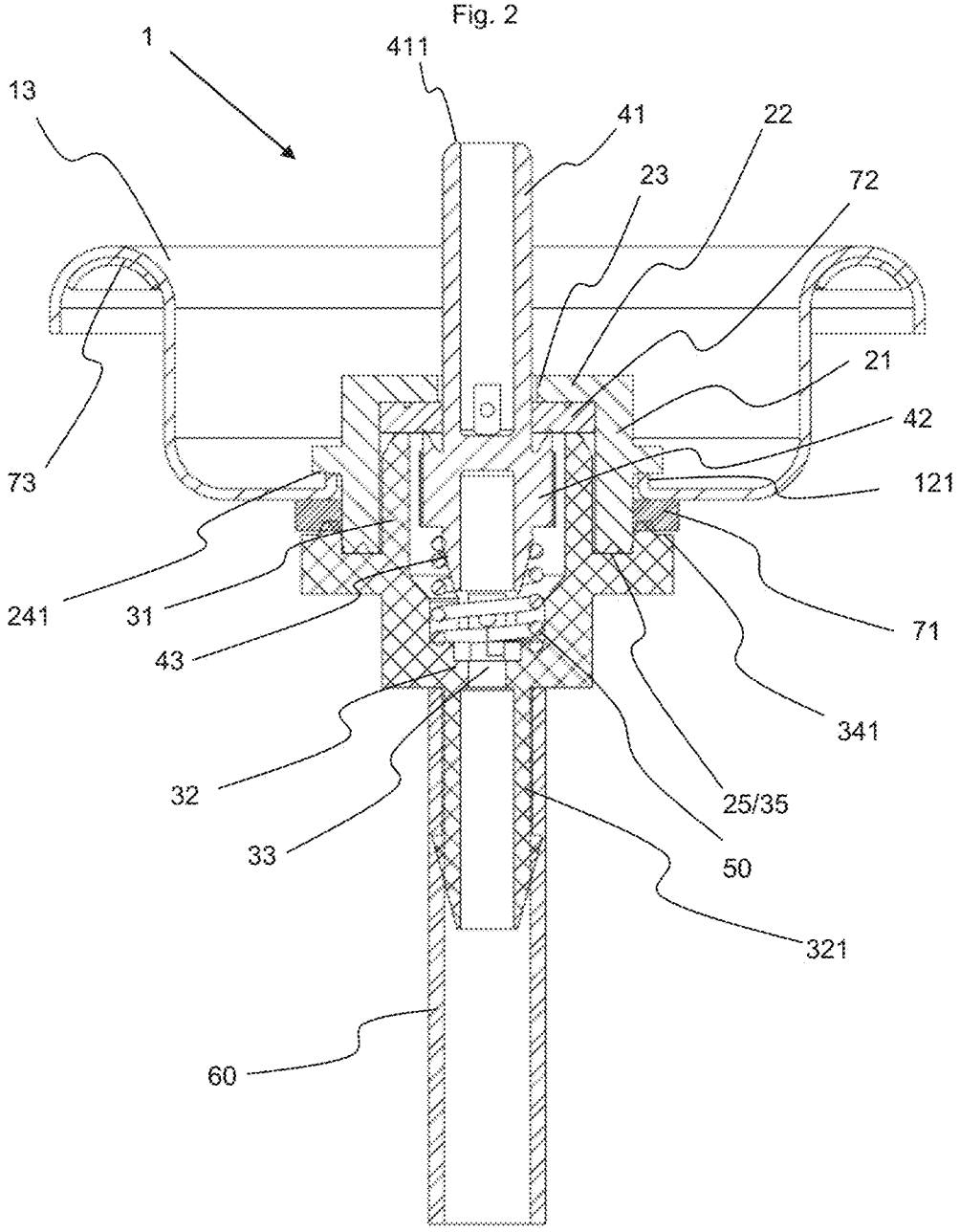
Figure 3:
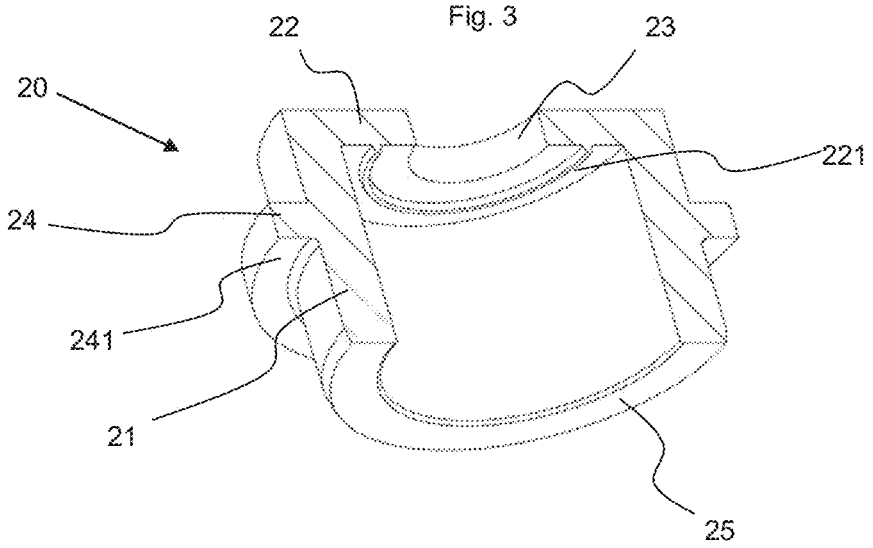
Figure 4:
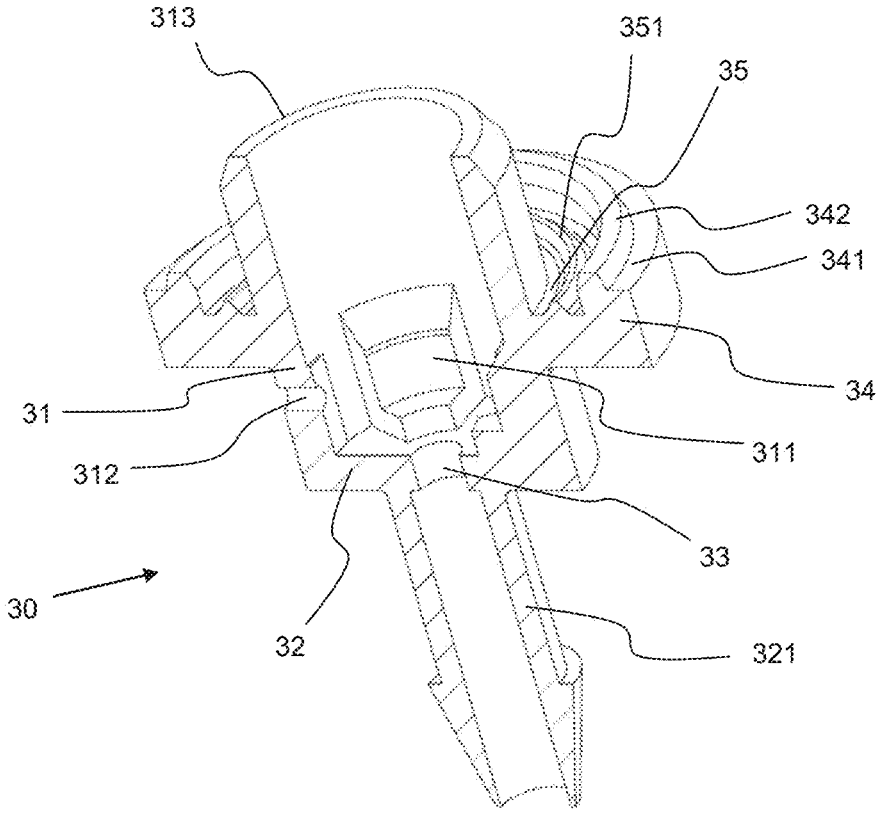
Figure 5:
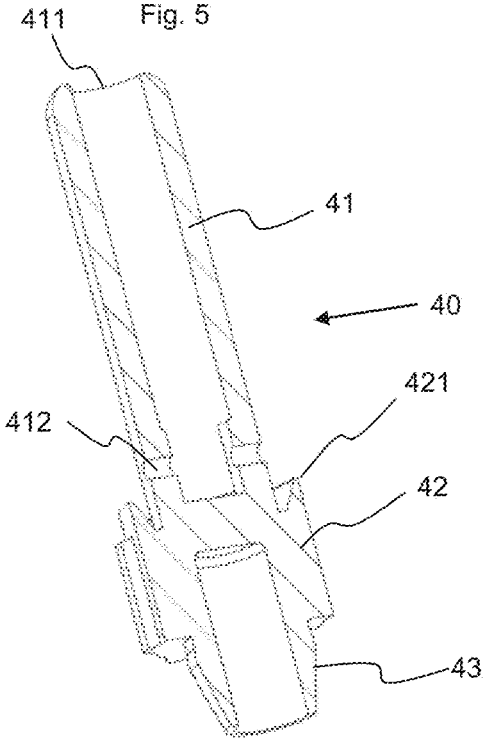
Figure 7:
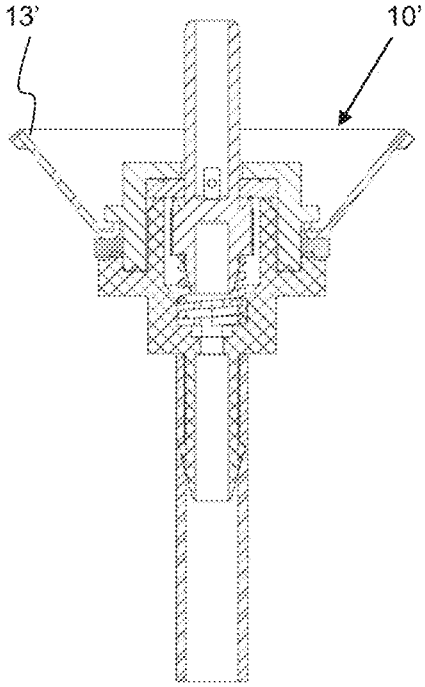
Figure 6A:
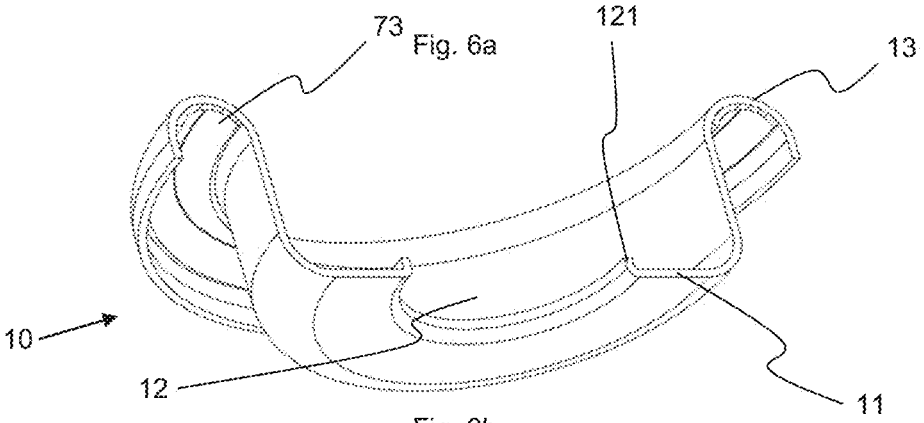

The invention is described in more detail below with the help of the figures which show:

FIG. 1: an exploded cross-sectional view of a valve according to a first embodiment of the invention;

FIG. 2: a front cross-sectional view of the valve of FIG. 1;

FIG. 3: a perspective and cross-sectional view of the outside part of the valve body of the valve of FIG. 1;

FIG. 4: a perspective and cross-sectional view of the inside part of the valve body of the valve of FIG. 1;

FIG. 5: a perspective and cross-sectional view of the stem of the valve of FIG. 1;

FIG. 6: a perspective and cross-sectional view of the cup of the valve of FIG. 1, with (a) a container seal and (b) a container seal and a cup seal overmolded on it;

FIG. 7: a front cross-sectional view of a valve according to a second embodiment of the invention.

The valve body and more generally the valve of the invention can be used in all positions. In the figures illustrating this application, the valve is shown with the stem directed upwards. The references "top"/"bottom" or "upper"/"lower" have only a relative value in relation to the representations of the appended figures. It is self-evident that the valve can be used in all positions and that what is up in the position shown here will not necessarily be so during use. Furthermore, the valve extends longitudinally relative to a main axis (A), which is vertical in the representations of the accompanying figures. The terms "radial", "axial" and "transverse" refer to this main axis (A).

As with any cup valve, the cup constitutes a separation between the side of the valve intended to be placed inside the container and the other side intended to be outside the container. The terms "inside" and "outside" refer to the elements located on the inside or outside of the cup. The terms "inner" and "outer" refer to a particular component (outside part or inside part) and define what is in or out of said component, regardless of whether it is a component located on the inside or outside face of the cup.

The example presented here is a male-type valve whose valve element is a stem, a portion of the rod of which protrudes out of the valve. The invention can also be applied to a valve of the female type whose valve element is a valve seat located in the valve body and requiring to be actuated by an outside rod (generally that of a diffuser) penetrating into the valve. The valve of the invention as presented here is composed of a two-part valve body (20, 30) in which is retained a stem (40), one of the ends (411) of which protrudes from the valve body. The valve body is composed of an outside part (20) and an inside part (30). In the assembled position, the two parts (20, 30) of the valve body block the cup (10) between them, preferably with the interposition of a cup seal (71).

The inside part (30) of the valve body has an essentially tubular shape around the axis (A), here a cylindrical shape. It is constituted by a first cylindrical wall (31) partially closed on one side (lower side) by a first closure wall (32) which is preferably planar and radial. A first orifice (33) is made in the center of the first closure wall (32), orifice through which the product to be extracted penetrates. A first annular bearing wall (34) is placed on the outer face of the first cylindrical wall (31), which first bearing wall (34) is symmetrical with respect to the axis (A) and goes completely around the first cylindrical wall. The peripheral edge of its upper face, which face is directed towards the cup, constitutes a first annular bearing surface (341) for the cup. In the present example, the first bearing wall (34) is located at a distance from the first closure wall (32) and the first bearing surface (341) is radial. An annular sealing rib (342) can be made on the first bearing surface (341). This sealing rib (342) serves to improve sealing between a cup seal (71) and the inside part (30) of the valve body. More centrally than the first bearing surface (341), the upper face of the first bearing wall (34) has a groove. The bottom of the groove constitutes a first fastening surface (35) for welding the two parts (20, 30) of the valve body. An extra thickness of material (351) can also be provided on the first fastening surface (35) to serve as an energy director during ultrasonic welding of the two parts (20, 30) of the valve body. It can therefore be seen that the first fastening surface (35) is located inside a projection along the main axis (A) of the first bearing surface (341). The first fastening surface (35) could however be in the extension of the first bearing surface (341), or even be offset upwards. The inner face of the first cylindrical wall (31) can have, near the first closure surface (32), guiding shoulders (311) serving as a housing for the spring (50). In the example shown here, there are three shoulders distributed regularly and symmetrically with respect to the main axis (A). If the propellant gas must also be withdrawn, one or more channels (312) can be provided in the first cylindrical wall (31), between the first closure wall (32) and the first bearing wall (34), to set in contact the inner face and the outer face of the first cylindrical wall (31). A tenon (321) can be placed on the outer face of the first closure wall (32), around the first orifice (33), to allow fastening a dip tube (60), a pouch anti-collapsing device or any other similar device.

The outside part (20) of the valve body also has an essentially tubular shape around the axis (A), here a cylindrical shape. It is constituted by a second cylindrical wall (21) open on one side (lower side) and partially closed on the opposite side (upper side) by a second closure wall (22) which is preferably planar and radial. The edge of the second cylindrical wall (21) opposite to the second closure wall (22) constitutes a second fastening surface (25) for welding the two parts (20, 30) of the valve body. The transverse contour of this second fastening surface (25) is identical to the transverse contour of the first fastening surface (35) of the inside part, so that the two transverse contours are superimposable. A second orifice (23) is made in the center of the second closure wall (22), the rod of the stem passing through this orifice in the assembled state of the valve. A second annular bearing wall (24) is placed on the outer face of the second cylindrical wall (21), which second bearing wall (24) is symmetrical with respect to the axis (A) and goes completely around the cylindrical wall. Its lower face, oriented towards the cup, constitutes a second bearing surface (241) for the cup. In the present example, the second bearing wall (24) is placed at a distance from the second fastening surface (25) and the second closure wall (22), and the second bearing surface (241) is radial. The inner face of the second cylindrical wall (21) can be provided with retaining means for holding a valve seal (72), when the latter is not overmolded, in particular during assembly of the valve. These retaining means can be constituted by the rim of a cavity made in the inner face of the second cylindrical wall (21) near the second closure wall (22). At the level of this cavity, the inner face of the second cylindrical wall has a larger transverse cross-section than in the rest of the second cylindrical wall. Another solution is to provide a radial peripheral rib or a series of protrusions behind which the valve seal (72) can be placed and kept in contact with the second closure wall (22). To improve sealing of the valve seal (72), an annular sealing rib (221) may be placed on the inner face of the second closure wall (22), around the second orifice (23), which sealing rib comes to bear on the valve seal (72).

In the example presented here, the first cylindrical wall (31) of the inside part (30) is dimensioned to be able to penetrate into the second cylindrical wall (21) of the outside part (20). In other words, the outer diameter of the first cylindrical wall (31) is smaller than the inner diameter of the second cylindrical wall (21). In addition, the height of this first cylindrical wall (31) is chosen so that its edge (313) opposite to the first closure wall (32) bears sealingly against the valve seal (72) placed against the second closure wall (22) when the valve is in the assembled state.

Furthermore, by placing, on the inside part (30), the first fastening surface (35) in a groove set back from the first bearing surface (341), a guiding and centering effect of the second fastening surface (25) relative to the first fastening surface (35) during assembly of the valve is obtained. This helps to facilitate the assembling.

The stem (40) is a traditional stem. It is composed of a cylindrical wall (41) open at its upper end (411) and closed at its lower end, forming an outlet channel for the product. One or more orifices (412) placed at the bottom of the outlet channel extend radially through the cylindrical wall to set in contact the inner face and the outer face of said cylindrical wall (41). The cylindrical wall (41) constitutes the product outlet rod. This cylindrical wall continues with a ring (42) of larger diameter having on its outer face vertical channels or vertical ribs allowing the product to bypass the ring. The outer envelope of this ring has a diameter slightly smaller than the inner diameter of the main cylindrical wall (31) of the inside part so that it can enter the latter while being guided. On its upper annular face, the ring (42) is provided with a sealing rib (421) to ensure sealing with the valve seal (72). The ring is extended downwards by a guiding tenon (43) intended to cooperate with the spring (50).

The cup (10) can be a conventional cup. Generally, it is formed of a wall (11) provided with a central opening (12) and a peripheral flange (13) intended for fastening it to a container. A container seal (73) is placed on the inside face of the peripheral flange to ensure sealing between the cup and the container. The container seal can be a separate component or, as in the examples shown here, it can be overmolded on the inside face of the cup. In the example shown here, the wall (11) is planar and radial around the opening (12) and rises upwards at the opening so as to form a collar (121). This collar serves in particular to rigidify the wall at the planar and radial portion. In the direction of the peripheral edge, beyond the planar and radial part, the wall rises upwards, forming a substantially cylindrical wall section that ends with the peripheral flange (13) having a rolled shape. The valve body of the invention can be used with cups of any shape. Another example of a cup is shown in FIG. 7.

Figure 6B:
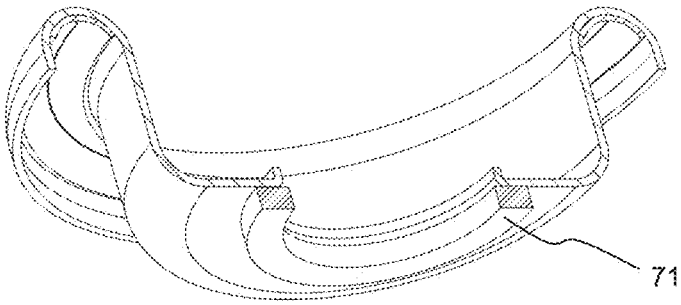

The seals (71, 72, 73) can be additional components, installed during assembly of the valve. They can also be overmolded. For example, the valve seal (72) can be overmolded on the inner face of the closure wall (22) of the outside part, while leaving the orifice (23) open. The cup seal (71) can be overmolded on the inner face of the cup (1), as shown in FIG. 6*b*, or on one of the bearing surfaces (241, 341). If the seal is overmolded on a bearing surface, the sealing rib (342) can be omitted. The container seal (73) can be overmolded on the peripheral flange (13) of the cup.

The valve is obtained as follows. The valve seal (72) is placed in the bottom of the outside part (20), bearing against the inner face of the second closure wall (22). The stem (40) is then introduced by its upper end (411) into the second orifice (23) of the outside part (20) so that the ring (42) is bearing with its sealing rib (421) against the valve seal (72). The spring (50) is placed on the guiding tenon (43) of the stem. The cup (10) is fitted over the outside part so that the edge of its opening (12) surrounds the portion of the outer face of the second cylindrical wall (21) located below the second bearing wall (24), the collar (121) bearing against the second bearing surface (241). The cup seal (71), if it is not overmolded, is placed on the cup. The inside part (30) is then put in place by inserting the first cylindrical wall (31) into the second cylindrical wall (21) of the outside part (20). The spring (50) then takes place between the shoulders (311) located at the bottom of the inside part (30) and bears against the inner face of the first closure wall (32), thus pushing the stem against the valve seal (72). The second fastening surface (25) located at the free end of the second cylindrical wall (21) of the outside part penetrates into the groove at the bottom of which the first fastening surface (35) is made. The two parts (20, 30) of the valve body are then welded, for example by ultrasound welding, the extra thickness (351) of material serving as energy director.

Sealing between the different parts is ensured by different means, some of which are redundant. For example, the following can be mentioned:

- the valve seal (72) which ensures sealing (i) with the inner face of the second closure wall (22), and in particular with the sealing rib (221), (ii) with the stem (40) that it surrounds in a sealed manner at the cylindrical wall (41), the sealing rib (421) of the ring of the stem bearing against the valve seal, and (iii) with the inside part (30) which bears on it with the end (313) of the first cylindrical wall (31);
- the weld between the two parts (20, 30) of the valve body at the fastening surfaces (25, 35, 351);
- the cup seal (71) which provides sealing (i) at the junction between the two parts (20, 30) of the valve body, on the one hand, by surrounding in a sealed manner the portion of the second cylindrical wall (21) of the outside part located between the second bearing wall (24) and the second fastening surface (25), and on the other hand, by bearing on the sealing rib (342) of the first bearing surface (341) of the inside part (30), and (ii) at the cup (10) and the valve body (20, 30) by bearing against the inner face of the cup at the wall (11) surrounding the opening (12) and the collar (121).

It is understood that the two bearing surfaces (241, 341) are oriented according to the orientation of the cup at the central opening (12). Here, the wall of the cup is planar and radial around the central opening and the collar: the two bearing surfaces are also planar and radial. If the wall of the cup is inclined around the opening, the bearing surfaces (241, 341) can also be inclined in a similar manner. If the wall of the cup is rigid enough, it is also possible to dispense with the collar (121).

The valve shown here is a male type valve. The valve is constituted by a stem (40), a portion (41) of which has a tubular shape and passes through the outside closure wall (22) via the second orifice (23) and protrudes outside the valve. This tubular portion constitutes a rod through which the product exits. The valve body of the invention can also be used to form a female type valve. In this case, the stem (40) is replaced by a valve seat (sometimes also called a piston) which cooperates with the rod of a diffuser, the rod of the diffuser penetrating into the valve through the second orifice (23) to press on the valve seat and open the valve. The second orifice (23) is therefore always dimensioned to allow a rod to pass though, either the rod of the stem itself, or that of the diffuser, not belonging to the valve.

The inside part (30) can be provided with a surface for welding a pouch and thus form a bag-on valve.

As shown in FIGS. 3 and 4, the two bearing surfaces (241, 341) are constituted by continuous surfaces. It would however be conceivable for at least one of the two bearing surfaces to be discontinuous and formed of a succession of sections spaced from one another and distributed over the entire circumference of the outer face of the part considered. It would even be conceivable for the two bearing surfaces to be discontinuous. In this case, the cup seal is preferably overmolded on one or the other of the two bearing surfaces.

The cup seal could be placed between the outside part (20) and the cup (10), rather than between the cup (10) and the inside part (30) as shown in the figures. In this case, the collar (121) can be made so that it is directed towards the first bearing surface (341).

In the example presented here, the space in which the stem is located is defined, on the one hand, by the inner face of the first closure wall (32) and the first cylindrical wall (31) of the inside part (30), and on the other hand, by the inner face of the second closure wall (22) of the outside part associated with the valve seal (72). In other words, the first cylindrical wall (31) of the inside part comes to be nested in the second cylindrical wall (21) of the outside part, so that these two parts partly overlap.

It is however possible to avoid this overlap by shortening the first cylindrical wall (31) of the inside part so that the space for the stem (the cylindrical body) is defined in its outside portion by the second cylindrical wall (21) and the second closure wall (22) of the outside part, and in its inside portion by the shortened first cylindrical wall (31) and the first closure wall (32) of the inside part. In this case, the second cylindrical wall (21) of the outside part must be resized so that its inner diameter is identical to that of the shortened first cylindrical wall (31) of the inside part. In all cases, the free end of the cylindrical wall (21, 31) carrying one of the fastening surfaces (25, 35) of one of the parts passes through the central opening (12) of the cup to come in contact with the fastening surface (25, 35) of the other part. In other words, the bearing wall (24, 34) of at least one of the two parts is located at a distance from the fastening surface (25, 35) of said part. In a variant embodiment, one of the two parts, the outside part for example, does not have a cylindrical wall (21) and the bearing wall (24) is located in the extension of the closure wall (22), at its periphery. The fastening surface is also placed on the bearing wall, radially more toward the center than the first bearing surface. With this solution, the valve body is practically completely enclosed within the container of the aerosol generator, and only the closure wall (21) with the support wall (24) and the free end of the stem (41) protrude above the cup (1). In the case where one of the two parts is constituted by only its closure wall, it is still possible to provide centering means. For example, if the valve seal is overmolded on the inner face of the closure wall, the peripheral edge of this valve seal can play the role of centering means, especially considering that it has no sealing function with the tubular wall of the other part, since the two are welded together. Another solution consists in providing nesting between the two parts, for example by making the fastening surfaces so that they are not radial, as is the case in the example presented here, but frustoconical and of complementary shapes.

Instead of welding the fastening surfaces (25, 35) of the two parts (20, 30) to form the valve body while trapping the cup (1) between the two bearing surfaces (241, 341), it would be possible to use other fastening means, for example by snap-fitting or gluing.

It would be possible to reverse the two parts (20, 30), only the orifices being modified so that the stem continues to protrude from the outside part and the product continues to enter through the inside part.

The cup can be in aluminum, tinplate or a polymer material such as polyethylene terephthalate (PET) or polyethylene naphthalate (PEN). The two parts (20, 30) of the valve body are preferably in a polymeric material, in particular POM, PA, PE, PP or PBT. The seals are in elastomer of the neoprene, butyl, chlorobutyl type, in synthetic rubber (Buna®) or in fluoroelastomer (Viton®). If they are overmolded on the cup or on the parts (20, 30) of the valve body, they are preferably in thermoplastic elastomer (TPE) or in thermoplastic polyurethane (TPU). The valve (stem (40) or valve seat) is for example in POM, PA or PBT. The spring is in stainless steel or a polymeric material, such as polyetheretherketone (Peek). The dip tube (60) can be made of PE.

The valve can be used for all kinds of applications, especially in the fields of cosmetics, pharmaceuticals, veterinary products, foods, technical products, household products, etc.

The valve is assembled by nesting then welding the two parts by ultrasonic welding, forming the new valve body which thus traps the cup. This approach leads to precise control of the assembly parameters and therefore to an assembly that is reliable in terms of sealing, height of the stem and actuation of the valve.

There is no longer any sealing problem thanks to the welding of the two parts to each other. The valve body no longer runs the risk of being deformed as is the case with crimping, which eliminates the risk of the stem getting stuck or requiring too much actuation force. Without crimping, there is no longer any problem of dimensions to be followed, nor any risk of the cup cracking following its deformation due to crimping in the direction opposite to the deformation due to stamping of the cup. The height of the stem (concretely, of the protruding end of the stem), no longer depends on the crimping and on the wear of the crimping pliers, but on the precision of molding of the two parts, which is easier to control.

Although the new valve includes an additional component, namely the cup seal (71), the fact that the cup and valve seals can be overmolded simplifies the assembling operations. This overmolding of the seals, which no longer need to be fitted, contributes to saving time during the mounting operation, as well as to gaining in reliability of the sealing of the valve, the seal no longer being at risk of being wrongly placed or of moving before assembly of the valve ends.

REFERENCES

1 Valve
10 Cup
  11 Wall of the cup
  12 Central opening
    121 Upright collar surrounding the central opening
  13 Peripheral flange
20 Outside part of the valve body
  21 2nd cylindrical wall
  22 2nd closure wall
    221 Sealing rib
  23 2nd orifice
  24 2nd bearing wall
    241 2nd bearing surface
  25 2nd fastening surface
30 Inside part of the valve body
  31 1st cylindrical wall
    311 Guiding shoulders
    312 Channels for the propellant gas
    313 Edge of the 1st cylindrical wall
  32 1st closure wall
    321 Tenon for dip tube
  33 1st orifice
  34 1st bearing wall
    341 1st bearing surface
    342 Sealing rib
  35 1st connecting surface
    351 Extra thickness of material
40 Stem
  41 Cylindrical wall
    411 Product outlet end
    412 Orifices
  42 Ring
    421 Sealing rib
  43 Guiding tenon
50 Spring
60 Dip tube
71 Cup seal
72 Valve seal
73 Container seal
A Main axis

The invention claimed is:

1. A valve body intended to be fastened to a cup provided with an opening in order to form an aerosol generator valve, the valve body comprising a tubular body closed at one of its ends by a closure wall provided with an orifice and extending along a main axis, wherein the valve body comprises two parts which are separate before assembly of the valve, one of the two parts being provided with the closure wall and a portion or all of the tubular body, and the other of the two parts being provided with another closure wall provided with another orifice and, if applicable, with the rest of the tubular body, each of the two parts being provided with a respective bearing surface and respective fastening means so that in the assembled state of the valve, one of the two parts is located on one side of the cup and the other of the two parts is located on the other side of the cup, a portion of at least one of the two parts passing through the opening of the cup so as to protrude on the other side of the cup, the two parts being fastened to each other by the respective fastening means, wherein the cup is clamped between the respective bearing surfaces of the two parts at an annular portion of the cup located around the opening.

2. The valve body according to claim 1, wherein the orifice of one of the two closure walls is dimensioned to allow an outlet rod for a product contained in the aerosol generator to pass through, the rod being carried by a valve element intended to be inserted at least partially into the valve body or by a diffuser intended to actuate the valve, the orifice of the other of the two closure walls being dimensioned to allow the product contained in the aerosol generator to enter the valve body.

3. The valve body according to claim 2, wherein a first of the two parts of the valve body is provided with a first tubular wall closed at one of its ends by a first of the two closure walls, a first bearing wall being formed on the outer face of the first tubular wall, the face of the first bearing wall opposite to the first closure wall constituting the first of the two bearing surfaces, and a second of the two parts of the valve body is provided with the second of the two closure walls and, if applicable, with a second tubular wall closed at one of its ends by the second closure wall, a second bearing wall being formed at the periphery of the second closure wall or on the outer face of the second tubular wall, the face of the second bearing wall opposite to the outer face of the second closure wall constituting the second of the two bearing surfaces.

4. The valve body according to claim 3, wherein the fastening means of the first part are constituted by a first fastening surface formed on the outer surface of the first tubular wall inside a projection, relative to the main axis, of the first bearing surface, or said first fastening surface is formed on the edge of the first tubular wall opposite to the first closure wall, and the fastening means of the second part are constituted by a second fastening surface formed at the periphery of the second closure wall inside a projection, relative to the main axis, of the second bearing surface, or said second fastening surface is formed on the second tubular wall, the two fastening surfaces having superimposable shapes.

5. The valve body according to claim 3, wherein the first tubular wall is dimensioned to form the tubular body of the valve body, so that, in the assembled state of the valve, the end of the first tubular wall opposite to the first closure wall is in contact with the second closure wall of the other part.

6. The valve body according to claim 5, wherein the first fastening surface is formed on the edge of the first tubular wall opposite to the first closure wall, and the second fastening surface is formed on the second closure wall, the second bearing surface being formed on the periphery of the second closure wall, the second part not having a second tubular wall; or the first fastening surface is formed on the outer face of the first tubular wall, and the second fastening surface is formed on the edge of the second tubular wall, the second bearing surface being formed on the periphery of the second closure wall or on the outer face of the second tubular wall.

7. The valve body according to claim 3, wherein the first tubular wall and the second tubular wall have superimposable transverse cross-sections and together constitute, in the assembled state of the valve, the tubular body of the valve body, the first fastening surface being formed by the edge of the first tubular wall opposite to the first closure wall and the second fastening surface being formed by the edge of the second tubular wall opposite to the second closure wall.

8. The valve body according to claim 2, wherein a valve seal is provided against the inner face of the closure wall provided with the orifice dimensioned to let the product outlet rod located on the valve element or on a diffuser pass through, the valve seal being dimensioned to ensure sealing between a valve element placed in the valve body and the inner face of said closure wall as well as between the product outlet rod and the orifice of said closure wall.

9. A valve for aerosol generator, comprising a cup provided with an opening and adapted to be fastened by its peripheral edge to an aerosol container, a valve body according to claim 1, and a valve element housed at least partially in the valve body, wherein one of the two parts is located on one side of the cup and the other of the two parts is located on the other side of the cup, the two parts being fastened to each other by the respective fastening means while clamping, between the respective bearing surfaces, an annular portion of the cup located around the opening.

10. The valve according to claim 9, wherein a cup seal is interposed between the cup and one of the bearing surfaces to ensure sealing at the interface between the cup and the bearing surface, the bearing surface preferably being provided with a sealing rib intended to be compressed against the cup seal in the assembled state of the valve.

11. The valve according to claim 10, wherein the cup seal is dimensioned to also ensure sealing at an interface between the two parts of the valve body.

12. The valve according to claim 10, wherein the cup seal is overmolded on the cup.

13. The valve according to claim 10, wherein the edge of the opening of the cup is deformed towards one of the faces of the cup to form an annular collar, an edge of the collar bearing against one of the bearing surfaces in the assembled state of the valve.

14. A valve for aerosol generator, comprising a cup provided with an opening and adapted to be fastened by its peripheral edge to an aerosol container, a valve body according to claim 4, and a valve element housed at least partially in the valve body, in which one of the two parts is located on one side of the cup and the other of the two parts is located on the other side of the cup, the two parts being fastened to each other by the respective fastening means while clamping, between the respective bearing surfaces, an annular portion of the cup located around the opening, wherein the two parts are fastened to each other while clamping the cup between them by irreversible fastening of their fastening surfaces to each other.

15. The valve according to claim 14, wherein the two parts are fastened to each other by welding using an extra thickness of material for welding provided on one of the fastening surfaces.

16. The valve according to claim 13, wherein the edge of the collar is a planar annular edge.

17. The valve body according to claim 1, wherein a cup seal is overmolded on one of the bearing surfaces.

18. The valve body according to claim 2, wherein a fastening tenon is provided around the orifice on the outer face of the other closure wall in order to fasten a dip tube, an anti-collapsing device or another similar device to the valve body.

19. The valve body according to claim 4, wherein one of the two fastening surfaces is provided with an extra thickness of material for welding.

20. The valve body according to claim 6, wherein the first fastening surface is formed in a groove formed on the first bearing wall inside the first bearing surface.

* * * * *